US005100000A

United States Patent [19]

Huseman

[11] Patent Number: 5,100,000

[45] Date of Patent: Mar. 31, 1992

[54] SUSPENDABLE BAG AND SUPPORT STRUCTURE

[75] Inventor: David C. Huseman, Brentwood, Tenn.

[73] Assignee: Packaging Innovations, Inc., Nashville, Tenn.

[21] Appl. No.: 708,822

[22] Filed: May 28, 1991

Related U.S. Application Data

[63] Continuation of Ser. No. 512,585, Apr. 23, 1990, abandoned, which is a continuation of Ser. No. 296,440, Jan. 12, 1989, abandoned.

[51] Int. Cl.[5] ..... B65D 85/62; B65D 33/14; B65B 67/04

[52] U.S. Cl. ..... 206/554; 248/100; 383/9; 383/35; 383/65; 383/37

[58] Field of Search ..... 248/95, 97, 100; 206/554, 610; 383/7, 9, 32, 35, 37, 63, 65

[56] References Cited

U.S. PATENT DOCUMENTS

| | | | |
|---|---|---|---|
| 538,712 | 5/1895 | Stuart . | |
| 981,639 | 1/1911 | Hall . | |
| 3,263,347 | 8/1966 | McCutcheon . | |
| 3,402,749 | 9/1968 | Kinzler | 383/10 |
| 3,685,645 | 8/1972 | Kanaguchi | 206/610 X |
| 3,777,930 | 12/1973 | Ericson . | |
| 3,889,871 | 6/1975 | White . | |
| 3,918,589 | 11/1975 | Nausedas . | |
| 4,046,257 | 9/1977 | Lehmader | 206/554 X |
| 4,175,602 | 11/1979 | Calavaris et al. | 383/9 X |
| 4,290,467 | 9/1981 | Schmidt . | |
| 4,305,503 | 12/1981 | Membrino | 206/554 |
| 4,458,466 | 7/1984 | Carbone et al. | 229/87.01 X |
| 4,527,693 | 7/1985 | Membrino | 206/554 |
| 4,543,084 | 9/1985 | Bailey . | |
| 4,560,068 | 12/1985 | Membrino | 206/554 |
| 4,586,319 | 5/1986 | Ausnit | 53/468 |
| 4,611,719 | 9/1986 | Dudek et al. . | |
| 4,635,294 | 1/1987 | Bentsen | 383/37 |
| 4,651,504 | 3/1987 | Bentsen | 53/452 |
| 4,665,552 | 5/1987 | Lems et al. | 383/37 |
| 4,699,607 | 10/1987 | Lambrecht | 206/554 X |
| 4,733,780 | 3/1988 | Jensen | 206/554 |
| 4,734,148 | 3/1988 | Meyer | 383/37 X |
| 4,769,126 | 9/1988 | Roen et al. | 206/554 |
| 4,811,418 | 3/1989 | Reifenhauser | 206/554 X |
| 4,846,586 | 7/1989 | Bruno | 383/65 X |
| 4,854,451 | 8/1989 | Jensen | 206/554 |

FOREIGN PATENT DOCUMENTS

| | | | |
|---|---|---|---|
| 270432 | 4/1964 | Australia . | |
| 801563 | 12/1968 | Canada | 206/554 |
| 850483 | 9/1970 | Canada . | |
| 1341587 | 9/1963 | France | 206/554 |

OTHER PUBLICATIONS

Minigrip product information sheet 6/1/88.

*Primary Examiner*—Bryon P. Gehman
*Attorney, Agent, or Firm*—George Pappas

[57] ABSTRACT

A suspendable bag adapted for suspending on a structure and opening, filling, and severing away therefrom. A suspension wall extends from the bags and includes suspension holes adapted to receive suspension pegs located on the structure. A score line is provided below the suspension holes and a support hole is provided below the score line and above the bag. The support hole is adapted to receive a support bag located on the structure. During operation, the support hole, in conjunction with the support peg, allows the opening of a reclosable zipper at the mouth of the bag by only pulling on a lip connected to the front wall of the bag. The support hole, in conjunction with the support peg, further supports the back portion of the bag while the bag is being filled with various products.

6 Claims, 2 Drawing Sheets

SUSPENDABLE BAG AND SUPPORT STRUCTURE

This is a continuation of copending application Ser. No. 07/512,585 filed on Apr. 23, 1990, now abandoned, which is a continuation of application Ser. No. 07/296,440 filed on Jan. 12, 1989, now abandoned.

FIELD OF THE INVENTION

The present invention, in general, relates to plastic bags of the reclosable type. More particularly, the present invention relates to suspendable bags whereby the bags may be fixed on a structure so as to readily be opened, filled, and torn away from the structure quickly and easily and without allowing the bag to fall off of the structure during filling.

BACKGROUND OF THE INVENTION

Various plastic bags are presently manufactured and being used for holding and storing all types of materials and items ranging from nuts and bolts to meats and cookies. Such bags are generally made of a thin film of plastic and also range in size and holding capacity. Bags of this character are available to home owners as single bag units. Some of such bags include reclosable zippers whereby the bag is selectively openable and closable.

Deli markets and manufacturers of various products also utilize plastic bags for holding and storing their products. In these applications, it is quite often important that the bags be quickly accessible and fillable. Although numerous mechanical means have been devised for filling plastic bags with a desired product, many bag uses, such as in delis, unit dose pill packs, parts packaging by O.E.M.'s, butcher shops, etc., require manual filling of the bags.

In the past, various bags have been devised for such manual filling and for making the bags easily accessible and fillable. In this regard, Membrino, U.S. Pat. No. 4,560,068 discloses pads of plastic bags including a plurality of bag units stacked upon one another and attached at a salvage portion. A score line is provided in the salvage portion adjacent the mouth of the bag so as to permit tearing away of each bag unit from the salvage portion and, thereafter, for filling as needed. Furthermore, Membrino, U.S. Pat. No. 4,305,503 discloses connecting together the salvage portions so as to resist the forward pull on the lip of a bag as the bag is being torn away so that the bag may more readily be substantially fully opened and severed from the respective salvage portion at the same time. Another U.S. patent entitled "Block Sealed Flexible Saddle Bags", U.S. Pat. No. 4,733,780 also discloses facilitating the removal of a bag from a stack or block.

These various pads of bags adapted for manual filling, however, are undesirable and include substantial shortcomings and drawbacks. For example, most such packs require that the bag unit first be completely ripped away from the pack prior to being able to obtain access to the opening for opening the bag and filling the same. As can be appreciated, this is a two hand operation and, quite often, requires tremendous coordination by the user to properly hold the bag open and fill the same with various size products. Further, even if the bag unit is openable while on the pack, such as those disclosed in above discussed U.S. Pat. Nos. 4,305,503 and 4,560,068, the user quite often must still rip the bag unit completely off of the pack, shake the bag briskly so as to more fully open the mouth, and then proceed in the filling operation, again with two hands. Furthermore, such packs for manual filling operations do not utilize bag with reclosable zippers which are quite often desirable by the end user for selectively opening and closing the bag as desired.

Accordingly, a need exists for bag units in packs, or otherwise, for use in manual filling operations whereby the bag units are easily openable prior to being severed from the pack or stand that they may be fixed upon. The bags must also be easily fillable, preferably by a single operator or user using one hand for holding the bag open and the other for dropping the various products therein. The bags should also be easily openable and severable from the pack or stand and must also preferably utilize a reclosable zipper.

SUMMARY OF THE INVENTION

It is the principal object of the present invention to overcome the above discussed disadvantages and drawbacks associated with prior manual filling bag units and packs.

The present invention overcomes the disadvantages and drawbacks of the prior bag units and packs by providing bags which are suspendable on a structure or stand. The bags may be of the reclosable zipper type having front and back walls. A suspension wall extends from the back wall and is suspendable or attachable on the structure. Below the attachment to the structure, a score or perforation is provided on the suspension wall, and below the perforation, a support hole is provided for receiving a support peg from the structure. Thus, the operator or user initially pulls open the reclosable bag by grabbing the front wall or lip extending upwardly from the front wall above the zipper and pulling thereon. The complementary separable profiles of the reclosable zipper, thus, separate and, as this occurs, the suspension wall is severed or cut at the score line thereby allowing the bag to become fully open as the user continues to pull outwardly. The support peg, however, continues to support the back wall of the bag at the support hole and, thus, the operator or user may proceed in filling the opened bag with the free hand not used in opening and holding open the bag. Upon conclusion of the filling operation, the operator merely lifts the bag off of the support peg and causing the bag to become completely severed from the attached suspension wall portion. The reclosable zipper profiles may then be brought together and closing the bag with the contents therein.

In one form thereof, the present invention is directed to a bag that is suspendable on a structure. The suspendable bag includes a front wall and back wall joined together. A bag cavity is defined between the front and back walls and an opening leads to the bag cavity. A suspension wall extends from the back wall and a suspension element is located on the suspension wall for suspending the bag on the structure. A perforation element located on the suspension wall between the suspension element and the bag is provided for selectively severing the bag from the suspension element. A support element is provided on the suspension wall between the perforation element and the bag for supporting the bag on the structure between the perforation element and the bag.

In one form thereof, the present invention is directed to a plurality of bags that are suspendable on a structure. Each of these suspendable bags include a front wall and a back wall that are joined together. A bag cavity is defined between the front and back walls and an opening leads to the bag cavity. A suspension wall extends from the back wall and a suspension element on the suspension wall is provided for suspending the bag on the structure. A perforation element is located between the suspension element and the bag on the suspension wall for selectively severing the bag from the suspension element. A support element is provided on the suspension wall between the perforation element and the bag for supporting the bag on the structure between the perforation element and the bag. The plurality of suspendable bags are attached together at their respective suspension walls on the suspension element side of the perforation element.

In one embodiment, the plurality of bags are stacked into a pad over one another so that the front walls of the plurality of bags face in one direction. In another embodiment, two bags are attached in a saddle bag fashion so that when both bags are placed on a flat surface and, thus, being in a single plane, the front walls face in one direction and the back walls face in an opposite direction. A plurality of saddle bag fashion attached bags may be stacked into a pad over one another facing in the same direction, and the suspension walls of the stacked plurality of saddle bag fashion attached bags can be attached together.

BRIEF DESCRIPTION OF THE DRAWINGS

The above mentioned and other features and objects of this invention and the manner of obtaining them will become more apparent and the invention itself will be better understood by reference to the following description of embodiments of the invention take in conjunction with the accompanying drawings wherein.

Corresponding reference characters indicate corresponding parts throughout the several views of the drawings.

Figure 1:
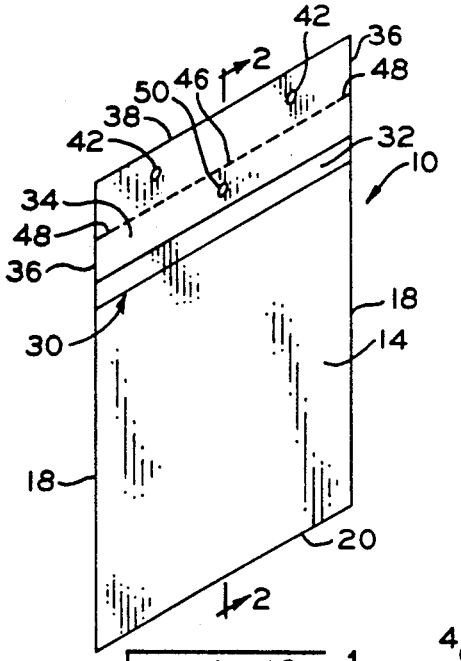
FIG. 1 is a perspective view of a suspendable bag according to the present invention.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

As shown in the drawings, a suspendable bag generally indicated as 10 is adapted to be hung or suspended on a structure such as that generally indicated as 12. Suspendable bag 10 includes a front wall 14 and a back wall 16. Walls 14 and 16 are made of a thin plastic film of polyethylene or synthetic resin suitable for forming such bags and are generally translucent. Walls 14 and 16 are joined at longitudinal wall seams 18 and bottom seam 20 by heat-sealing or other suitable means. Further, depending on the manufacturing process, walls 14 and 16 may be integral with one another at some of seams 18 and 20, while other of these seams may be joined by heat sealing. For example, if suspendable bag 10 is made from a single ply of plastic material bent at seam 20, seams 18 will be heat sealed, while walls 14 and 16 will be integral at seam 20.

Front wall 14 and back wall 16 further define a bag cavity or chamber 22. Bag cavity 22 is accessible through bag opening or mouth 24. As shown, opening 24 is preferably located between walls 14 and 16 and seams 18 and opposite seam 20 thereby maximizing the bag capacity. However, it is envisioned that bag opening 24 may be in other locations, for example, on front wall 14.

Figure 2:
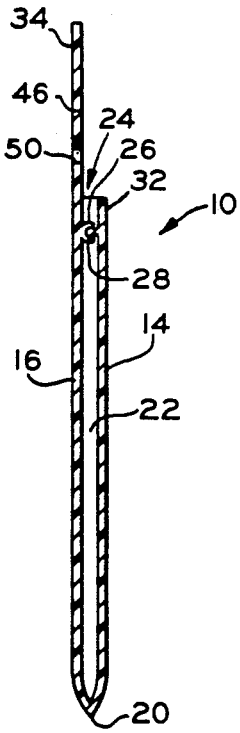
FIG. 2 is a cross sectional cut away view of the suspendable bag shown in FIG. 1 taken along line 2—2.
Figure 6:
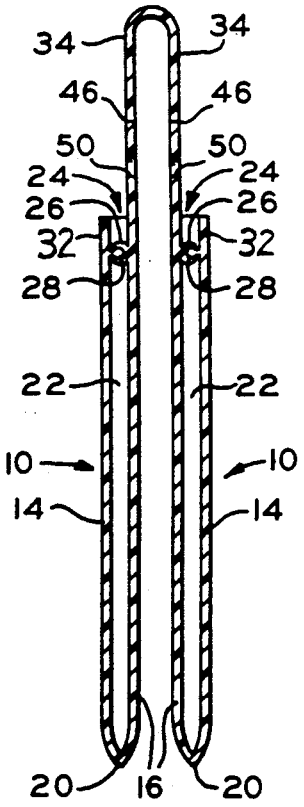
FIG. 6 is a cross sectional view similar to that of FIG. 2, however, showing two suspendable bags attached in a saddle bag fashion.

A reclosable zipper 30, including complementary separable profiles 26 and 28, is provided at opening 24 thereby making bag 10 selectively openable and closable and, thus, also selectively providing access to bag cavity 22. Separable profiles 26 and 28 are preferably located on walls 14 and 16 and are integral therewith. In FIGS. 2 and 6, complementary separable profile 26 is a groove element on back wall 16 and complementary profile 28 is a rib element on front wall 14. The rib and groove elements may, however, be manufactured interchangeably on walls 14 and 16 as needed.

A lip means, preferably in the form of an extension or lip 32, is provided on front wall 14 extending upwardly from reclosable zipper 30. Lip 32 is provided for gripping, for example, by the user between the forefinger and thumb and pulling front wall 14 away from back wall 16. Thus complementary separable profiles 26 and 28 may be separated causing bag 10 to be opened and providing access to bag cavity 22.

Figure 3:
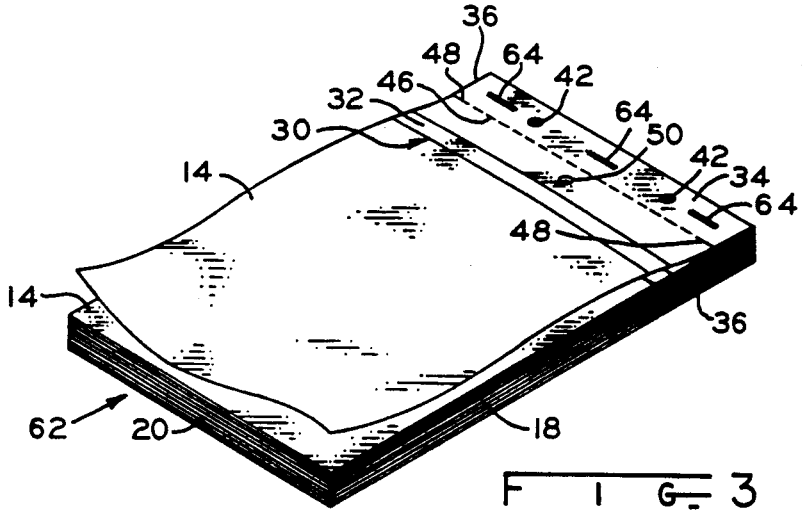
FIG. 3 is a perspective view of a plurality of attached suspendable bags shown in FIG. 1.
Figure 7:
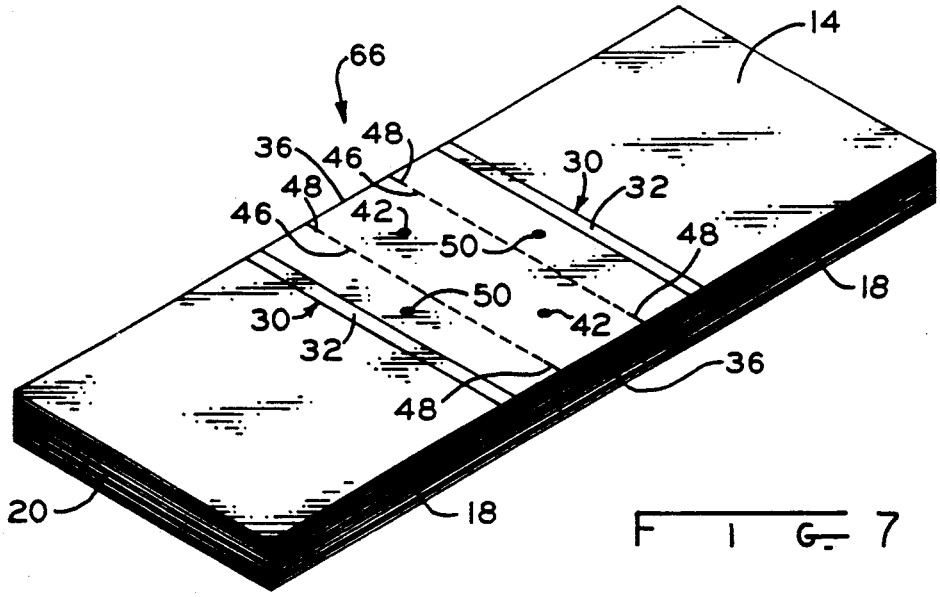
FIG. 7 is a perspective view of a plurality of saddle bag fashion attached bags stacked into a pad over one another; and, FIG. 8 is a perspective view of a plurality of saddle bag fashion attached bags on a support structure and showing the top bag open and hanging by a support element on a support peg.
Figure 8:
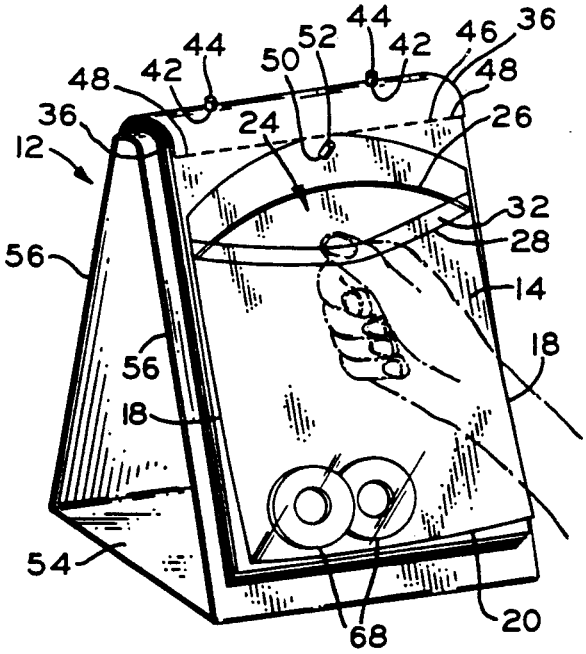

A suspension wall 34 extends upwardly from back wall 16 and is preferably integral therewith as shown in FIGS. 2 and 6. Suspension wall 34 is preferably also of the same width as bags 10 and includes edges 36. In one embodiment, as shown in FIGS. 1–3, suspension wall 34 has a top edge 38 while in another embodiment as shown in FIGS. 6–8, suspension walls 34 of bags 10 are connected or attached together, preferably integrally in a saddle bag fashion.

A suspension means is provided on suspension wall 34 for suspending bag 10 on a structure such as 12. Preferably, the suspension means is a plurality of suspension holes 42 on suspension wall 34. Holes 42 are adapted to receive complimentary suspension pegs 44 and, thus, support bag 10 on structure 12.

Suspension wall 34 further includes a perforation means between the suspension means and bag 10 for selectively severing the bag from the suspension means. Preferably a score or perforation line 46 is provided along suspension wall 34 between edges 36 so that bag 10 can be severed or "ripped" from the suspension means. The ends 48 of score line 46 are severed clear through for up to approximately one-half inch from edges 36 so as to aid the severing of bags 10 from the suspension means and to prevent the tearing of seams 18 as bag 10 is opened.

A support means is also provided on the suspension wall between the perforation means and the bag so as to support the bag on structure 12 between the perforation means and the bag. Preferably, the support means includes a support hole 50 between score line 46 and bag 10. Support hole 50 is adapted to receive a complimentary support peg 52 located on structure 12.

As briefly mentioned hereinabove, bags 10 are adapted to be suspended on a structure such as that generally indicated as 12. Structure 12 is substantially triangularly-shaped and includes a base 54 connected along bends 58 to angularly inclined upstanding walls 56. Upstanding walls 56 are joined or connected together at their upper ends thereof at bend 60. Base 54 and walls 56 are preferably made of sheet metal and are joined at bends 58 and 60, either integrally by bending thereat or, for example, when base 54 and walls 56 are separate sheet metal parts, by other suitable means such as welding. The width and height of structure walls 56 are adapted for supporting the particular size bags 10, for example, as shown in FIG. 8.

Figure 4:
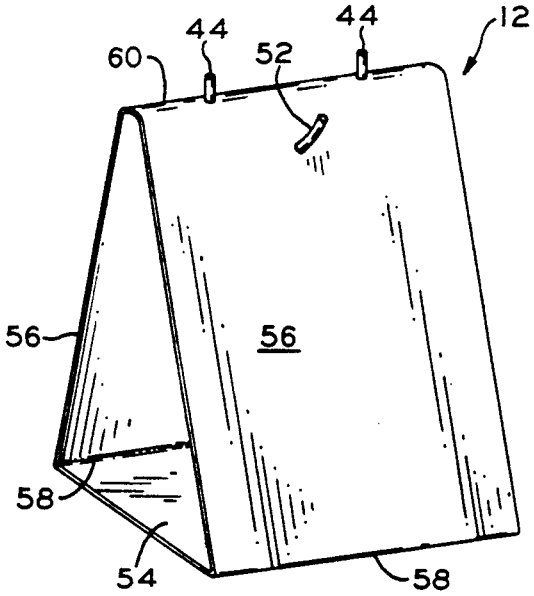
FIG. 4 is a structure or stand according to the present invention whereupon suspendable bags may be hung or suspended.
Figure 5:
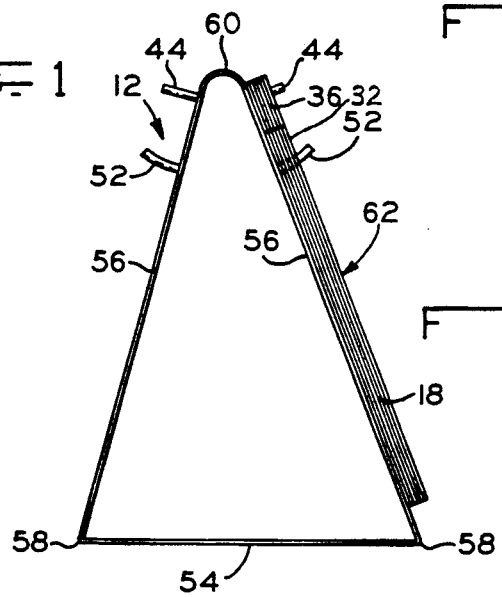
FIG. 5 is a side elevational view of a plurality of suspendable bags suspended on a structure.

Suspension pegs 44 are provided and extend vertically upwardly, as shown in FIG. 4, from the upper ends connection or curved bend 60. In the alternative, suspension pegs 44 may extend perpendicularly outwardly from a wall 56 as shown in FIG. 5. Furthermore, support pegs 52 are connected to walls 56 below the suspension pegs 44 and extend outwardly therefrom substantially perpendicularly. Support pegs 52 are preferably arcuate as shown and biased generally vertically upwardly and away from base 54. Pegs 52 and 44 are attached or connected to structure 12 by welding or other suitable means. It is noted that various structures can be devised whereupon suspendable bags 10 can be suspended including pegs attached to building walls or furniture or upstanding walls with suspension and support pegs connected thereto and attachable on building walls or furniture.

Suspendable bags 10 can be individually suspended on a structure 12 such as that shown in FIGS. 4 and 5 and used as needed. In the alterative, a plurality of suspendable bags 10 can be attached together as shown in FIG. 3 at their respective suspension walls on the suspension means side of the perforation means thus making a pad 62 of bags 10. Bags 10 of pad 62 are stacked over one another so that front walls 14 of the stacked bags 10 face in one direction. Bags 10 of pad 62 are attached together and forming a header above score lines 46 through the use of staples 64 that extend through all of the respective suspension walls and bind the same together. In the alternative, suspension walls 34 can be attached together by heat sealing such as, for example, by extending a hot needle therethrough and, thus, attaching the suspension walls by melting. In this regard, it is also envisioned that suspension walls 34 can be attached together at holes 42 in a similar fashion, for example, by extending a hot rod therethrough and melting and attaching suspension walls 34 at holes 42. Other methods of attaching bags 10 for forming pad 62 are envisioned and include tying together with string members. Pad 62 can be supported on structure 12 of FIGS. 4 and 5 similar to that of individual suspendable bags 10, and bags 10 used therefrom as needed.

In another alternative form, as shown in FIG. 6, bags 10 are attached together in a saddle bag fashion and share a common suspension means. These individual saddle bag fashion suspendable bags can be suspended on structure 12 as shown in FIG. 8 with pegs 44 being received through holes 42 and used as needed off of either side of structure 12 or walls 56.

In yet another alternate form, a plurality of saddle bag fashion attached bags, as shown in FIG. 6, are stacked into a saddle bag fashion pad 66 over one another and facing in the same direction as shown in FIG. 7. The plurality of saddle bag fashion attached bags are attached together at the suspension means or between score lines 46 and, thus, forming a header therebetween. As with pads 62, the saddle bag fashion attached bags are attached between score lines 46 by staples, heat sealing, string, or in any other suitable fashion. Pad 66 may then be suspended or placed on structure 12 as shown in FIG. 8 whereat suspension pegs 44 are received through suspension holes 42 and support pegs 52 are received through support holes 50. It should be noted that where holes 50 of pad 66 extend perpendicularly through pad 66, because support peg 52 is arcuate, peg 52 is more readily and properly received through holes 50 as pad 66 is placed on structure 12 because bags 10 at the bottom of pad 66 will tend to extend further downwardly than bags 10 at the top of pad 66.

In operation, whether individual bags 10 as shown in FIG. 1, or pad 62, or saddle bags as shown in FIG. 6, or pad 66 are suspended on a structure 12 as shown in FIGS. 4, 5, and 8, the user or operator can quite easily open, fill, and sever bags 10 as needed. More specifically, in operation, the user initially grips lip 32 and pulls front wall 14 away from back wall 16 and structure 12. Initially, during this pulling, complementary separable profiles 26 and 28 separate, thus, initiating the opening of bag 10. This initial opening occurs because direct tension is provided between the lip 32, reclosable zipper 30, and support hole 50 of suspension wall 34 that is being held back by support peg 52. As the bag is further opened, a pulling force is experienced on edges 36 of suspension wall 34. Accordingly, because the suspension wall portion above perforation line 46 is retained or held back by support pegs 44 and/or the header formed in pads 62 and 66, suspension wall 34 begins to rip along perforation line 46 inwardly from edges 36. This severing or ripping along perforation line 46 is aided by the severed end portions 48 of perforation lines 46. At this point, bag 10 is fully opened and substantially fully severed from the upper portion of suspension wall 34 as shown in FIG. 8. Further, the opening and partial severing was accomplished by merely pulling lip 32 with one hand away from back wall 16.

Upon the opening of bag 10 as described hereinabove, the bag can be retained in an open position by continuing to hold lip 32 away from support peg 52. Thus, the operator using his other hand can place products such as washers 68 or edible goods etc., in bag cavity 22. During this filling process, bag 10 is continued to be supported on structure 12 via support peg 52 and support hole 50, along with one of the operator's hands holding up lip 32. Thus, even substantially heavier products can be placed in bag 10, and bag 10 will continue to be supported via support peg 12 and one of the operator's hands.

Upon completion of the filling step, the operator merely lifts the filled bag 10 up and off of support peg 52 and completely severing bag 10 from the suspension wall portion above the perforation line 46. The separable profiles 26 and 28 are then again brought together and closing bag opening 24 with, for example, washers 68 within cavity 22. This process of using bags 10 by opening, filling, and severing away from structure 12 can continue until a pad 62 or 66 has been depleted or the individually suspended bags have been depleted. Then, the suspension wall portion or header above perforation line 46 is discarded and additional individual bags 10 or pads 62 or 66 are suspended for use on a structure 12.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In combination with a support structure including an upstanding wall, two suspension pegs connected to the upstanding wall and a support peg connected to the upstanding wall vertically below and horizontally between the two suspension pegs, a suspendable bag for opening and filling while supported on the support structure, said suspendable bag comprising:

a bag including a front wall and a back wall joined together, a bag cavity defined between said front and back walls and an opening leading to said bag cavity;

a reclosable zipper on said bag opening for opening and closing said bag;

a suspension wall extending from said back wall at said opening;

two suspension holes on the suspension wall, the suspension pegs received in said suspension holes for suspending said bag on the structure;

perforation means on said suspension wall between said suspension holes and said bag opening for selectively severing said bag from said suspension wall;

a support hole on said suspension wall between said perforation means and said bag opening, the support peg received in said support hole for retaining said back wall for opening said reclosable zipper and bag and for supporting said bag on the structure while filling; and, lip means extending from said front wall for gripping and pulling said front wall and opening said reclosable zipper and bag.

2. The combination of claim 1 wherein said opening is between said front wall and said back wall.

3. The combination of claim 2 wherein said reclosable zipper includes complementary separable profiles on said front wall and said back wall, said profiles being selectively attachable and separable from one another for opening and closing said bag and selectively providing access to said bag cavity.

4. The combination of claim 1 wherein said front wall and back wall are joined at least partially by heat sealing.

5. The combination of claim 1 wherein said perforation means is a score line along said suspension wall.

6. The combination of claim 5 wherein said score line includes two ends on an edge on said suspension wall, said ends being severed.

* * * * *

UNITED STATES PATENT AND TRADEMARK OFFICE

CERTIFICATE OF CORRECTION

PATENT NO. : 5,100,000

DATED : March 31, 1992

INVENTOR(S) : David C. Huseman

It is certified that error appears in the above-identified patent and that said Letters Patent is hereby corrected as shown below:

ON THE TITLE PAGE:

In the Abstract, line 8, change "bag" to -- peg --.

Col. 2, line 52, insert --a-- after "and";

Col. 3, line 33, change "take" to --taken--;

Signed and Sealed this

Twenty-third Day of November, 1993

*Attest:*

Bruce Lehman

BRUCE LEHMAN

*Attesting Officer*

*Commissioner of Patents and Trademarks*